United States Patent [19]

Balta

[11] 4,301,345

[45] Nov. 17, 1981

[54] KEY SWITCH ACTUATION BY TORSION SPRING

[75] Inventor: Justin Balta, N. Miami Beach, Fla.

[73] Assignee: Burroughs Corporation, Hollywood, Fla.

[21] Appl. No.: 124,945

[22] Filed: Feb. 26, 1980

[51] Int. Cl.[3] ..... H01H 9/00; H01H 13/52

[52] U.S. Cl. ..... 200/314; 200/159 R; 200/340

[58] Field of Search ..... 200/340, 314, 317, 159 R, 200/5 A, 67 C, 76

[56] References Cited

U.S. PATENT DOCUMENTS

| | | | |
|---|---|---|---|
| 3,286,050 | 11/1966 | Campbell et al. | 200/67 C |
| 3,920,943 | 11/1975 | LaPointe | 200/159 R |
| 4,029,924 | 6/1977 | Frank et al. | 200/340 |
| 4,056,700 | 11/1977 | Stannek | 200/340 |
| 4,112,284 | 9/1978 | Leworthy | 200/340 |

FOREIGN PATENT DOCUMENTS

| | | | |
|---|---|---|---|
| 1395479 | 5/1975 | United Kingdom | 200/340 |

*Primary Examiner*—Willis Little

*Attorney, Agent, or Firm*—Carl Fissell, Jr.; Kevin R. Peterson

[57] ABSTRACT

This invention relates to a novel actuation mechanism useful, for example, in key switch operation wherein a key stem shaped to mate with apertures in a keyboard arrangement or as individual switches contains oppositely disposed, inwardly deformable, flanged members for captivating the key stem within the key apertures and further includes a torsion spring carried by the key stem and adjustably mounted for rotative movement about a pivot on the key stem. The ends of the torsion spring are movably captivated by the supporting aperture, e.g. keyboard, which in operation provides an excellent resistive tactile feel, and ease of operation on the key release stroke.

8 Claims, 19 Drawing Figures

DEFLECTION IN DEGREES
POSITION OF LOAD R
$\alpha^\circ = \frac{\beta^\circ - 90}{2}$
$0^\circ \leq \beta^\circ \leq 270^\circ$
$F = T \times R \times \frac{\beta^\circ}{270} \times \cos\alpha^\circ$

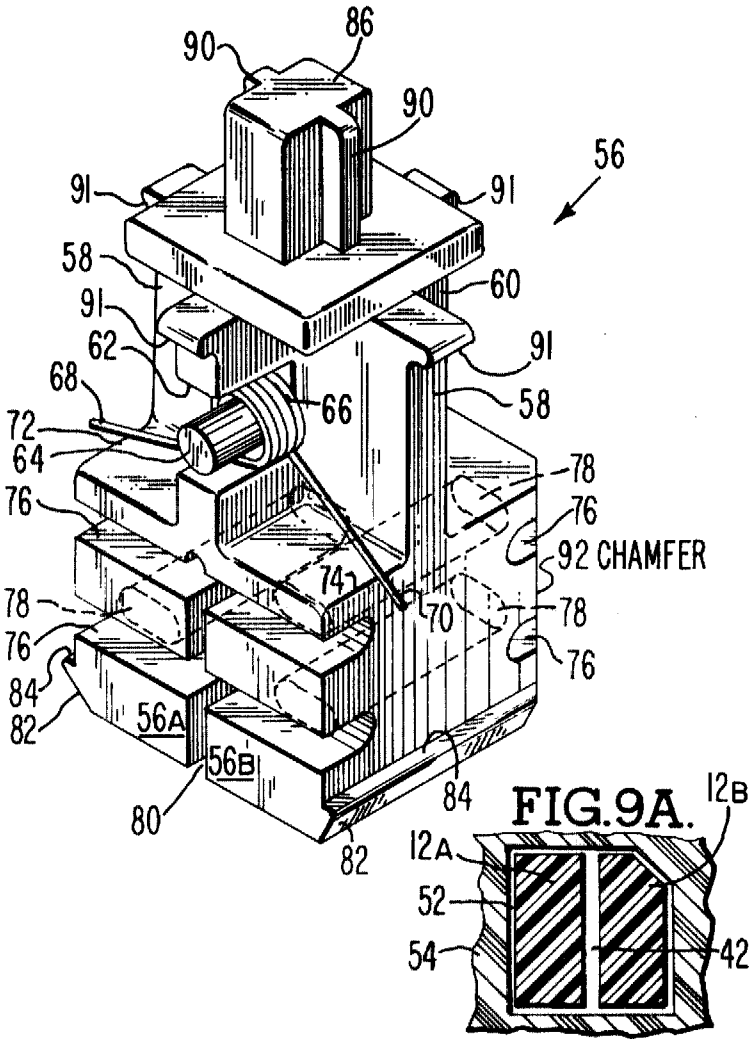
FIG.9.
FIG.9A.
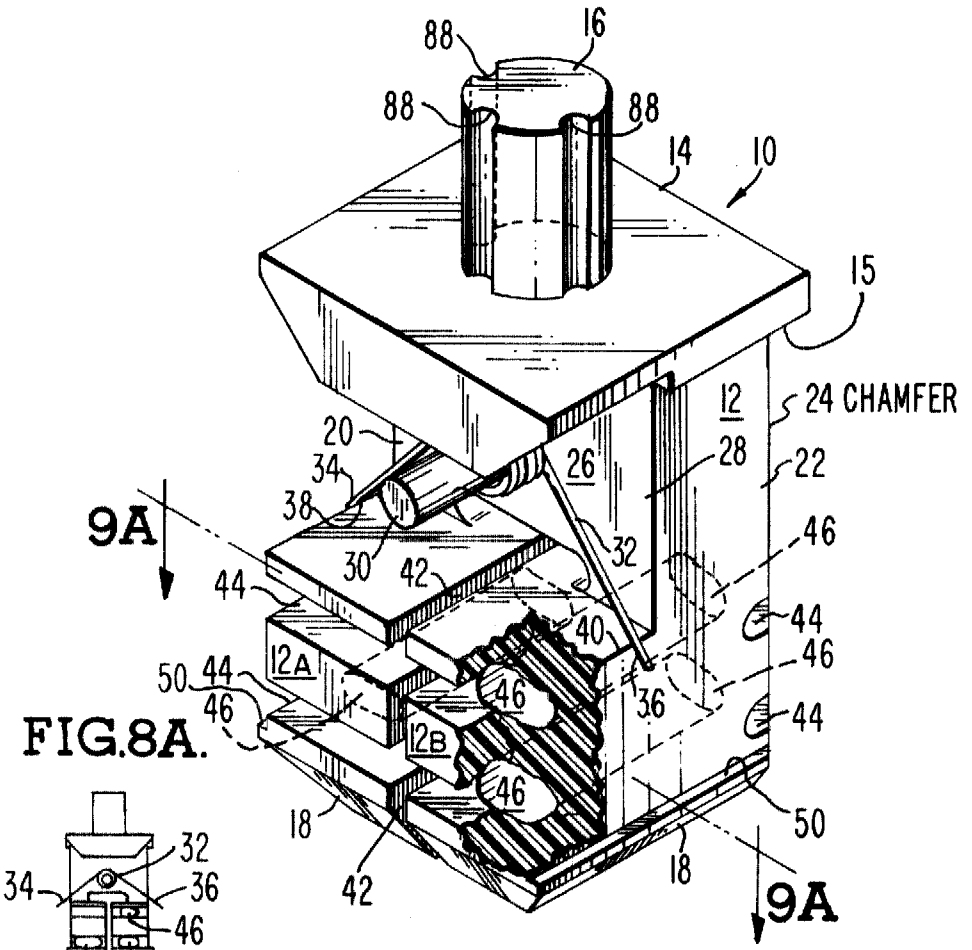
FIG.8.
FIG.8A.

KEY SWITCH ACTUATION BY TORSION SPRING

BACKGROUND OF THE INVENTION

1. Field of the Invention

The invention relates to actuating mechanisms such for example as those devices used for key switches and to key switches which are utilized with reconfigurable keyboards. With still more specificity the invention relates to a key switch for a reconfigurable photo optical keyboard having a novel actuating mechanism utilizing a torsion spring.

2. Description of the Prior Art

Prior art keyboard key switches generally utilize coiled springs one end of which (generally the bottom end of the spring) is secured to a base support member while the opposite end is secured to a movable portion of the key switch. The construction requires an upper and a lower attachment as well as some means to retain the key stem from falling out of the bottom of the base structure assembly. Usually this structure is the bottom or baseboard of the keyboard. Replacement, rearrangement or service of this type of key and keyboard arrangement requires special tools and is time consuming and inefficient. Also, the key switches of the prior art are generally relatively complicated in their construction and require a relatively large amount of tooling to fabricate and to insert into the keyboard, often requiring considerable hand work.

Other keyboard systems of the prior art produce wear characteristics which are highly undesirable.

Magnetic type key switches tend to have large variations in force and effect between keys for the operators. This lack of uniform increasing tactile feel is highly undesirable due to the operator's inability to detect when in fact the key switch has been closed.

SUMMARY OF THE INVENTION

The present invention provides a new, novel and heretofore unknown demountably, replaceable key switch and associated mechanism for use with a keyboard having key switch apertures for demountably retaining keys therein. The key switch actuation mechanism of the present invention comprises a key stem mounted for reciprocable movement relative to a fixed mounting member such as a keyboard and a torsion spring pivotally mounted on the key stem having flanged members for retaining the key stem within its operably associated key apertures within the mounting member. Opposing ends of the torsion spring abut the opposite edges of the key switch apertures. By adjusting the location of the torsion spring pivot on the key stem and the tension of the spring more or less initial actuator force is required to depress the key and close the switch. This mechanism thus produces a uniform descendent tactile feel and results in a repeatable condition without appreciable wear being detected over the useful life of the apparatus.

It is an important object therefore of the present invention to provide a demountable key switch actuation mechanism having an extremely low profile and without the requirement of a lower actuator support.

Another important object of the present invention is the provision of a key switch mechanism wherein the tactile feel is repeatable from key to key and remains constant and uniform over the wear life of the device.

A still further object of the invention is the provision of a key switch actuator means wherein changing the position of the actuator support means, i.e. the pivot point of the torsion spring, produces differing force characteristics with the same actuator means, i.e. the torsion spring.

An additional object and advantage of the invention is that because of the shape of the torsion spring in comparison to the usual coiled spring shape the spring lends itself quite easily to automation of the key switch assembly, which is not the case with the coil spring which tends to become entangled one with the other.

Another important object and feature of the present invention is that the torsion spring tends to provide self-centering of the key stem within the key aperture due to the arrangement of the spring ends with respect to the side walls of the supporting structure, particularly on the return stroke where external forces are removed.

Other objects, features and advantages of the present invention will be readily apparent in the following detailed description when considered in light of the accompanying drawings, which illustrate by way of example, and not limitation, the principles of the invention and preferred modes for applying those principles.

BRIEF DESCRIPTION OF THE DRAWINGS

FIG. 8 is an isometric view of one form of the actuation mechanism as functionally incorporated in a key switch device, FIG. 8*a* is a side elevational view to scale of one form of the actuation mechanism utilized with a key switch, FIG. 9 is an isometric view similar to the view of FIG. 8, but differing therefrom in that the structural support forming the key stem has been altered in physical configuration, FIG. 9*a* is a top plan view of a portion of a keyboard illustrating the polarizing means to prevent misalignment of the key stem upon insertion into the keyboard, and FIGS. 10 and 11*a–f* inclusive are schematic illustrations of a basic functional actuation mechanism embodying the present invention depicting two different structural arrangements for the torsion spring utilized therewith.

BRIEF DESCRIPTION OF THE PREFERRED EMBODIMENT

Figures 1, 2, 2A, 3, 4, 5:
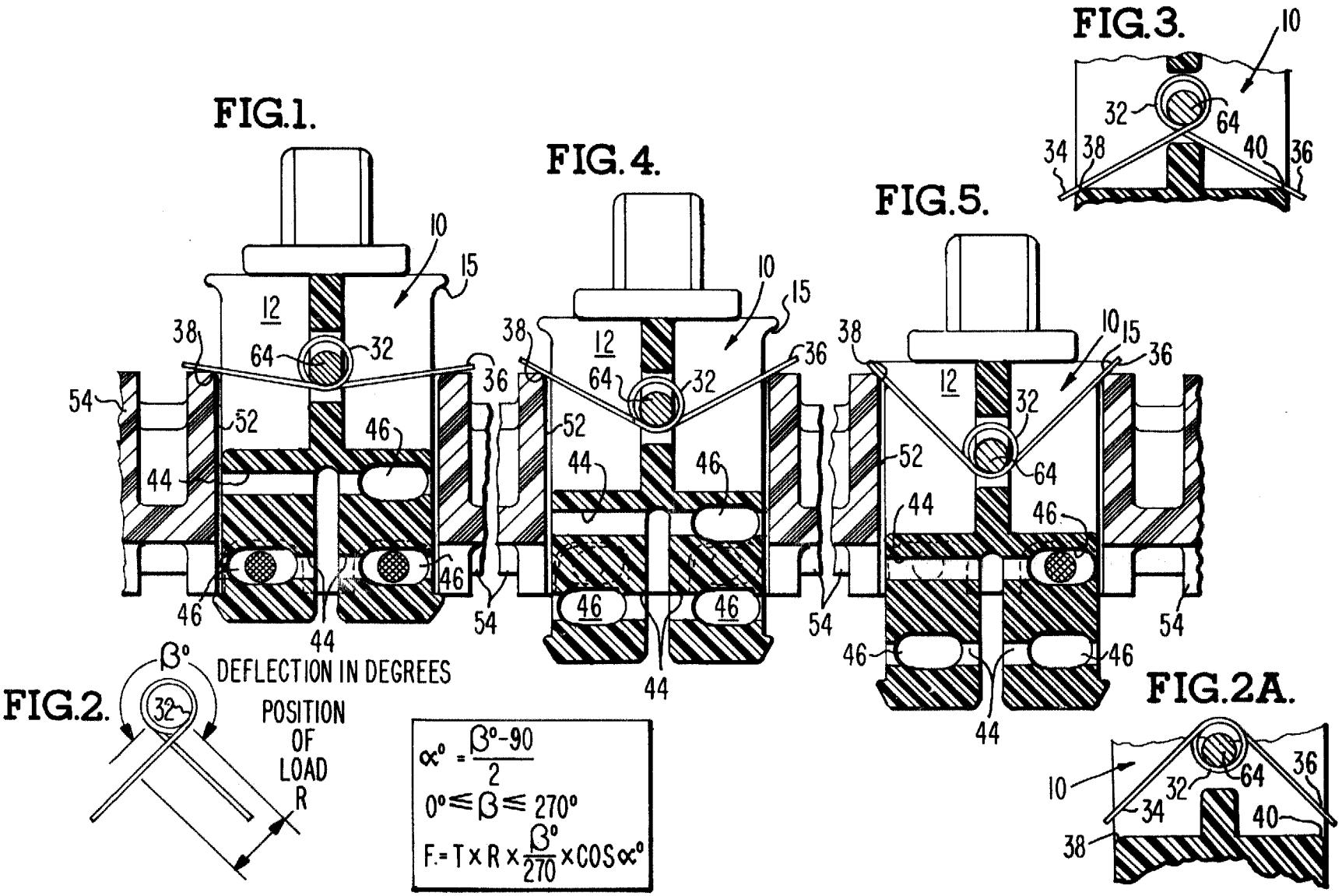
FIGS. 1, 4 and 5 are front elevational sectional views of the switch actuation mechanism of the present invention as incorporated in a photo optical keyboard assembly.
FIG. 2 is an illustrative representation of one form of torsion spring as used with the present invention.
FIG. 2*a* is a second form of the spring for use with the present invention.
FIG. 3 is a sectional side elevational view of a portion of the structure of FIGS. 1, 4 and 5 illustrating the spring in its preloaded or pretensioned condition vs. the free state of FIG. 2, assembled to the actuating mechanism.

With reference to the drawings, it is seen, that the present invention is illustrated in the environment of a keyboard wherein a plurality of vertically, reciprocably movable keys are arranged in a matrix of rows and columns (only a portion of a single row being illustrated in the drawing). However, it is noted that the actuation mechanism as herein described in and of itself is useful in a variety of structural permutations and accommodations quite apart from keyboards per se.

It has been prior practice in the keyboard switch art to employ coil springs, generally in a compression mode, wherein the spring is mounted between two oppositely disposed members one of which is fixed while the other is movable relative thereto. The compressive forces (actuation force) are varied by manufacture to accommodate a preset compression parameter or "touch." Normally, the compression force increases with the degree or amount of compression or travel of the actuating member e.g., push button, key, etc. Attempts to create so called "tactile feel" have been relatively unsuccessful since in a standard key switch it is difficult for an operator to determine by feel alone when the key switch contacts have been closed.

The actuation mechanism of the present invention on the other hand introduces and utilizes a torsion spring in a novel mechanism such that as the key switch actuator extends its travel the actuation force is varied over a wide operational range. Thus, the torsion spring is capable of producing a resistive (opposing) force which at first increases and then decreases with further travel effectively providing "tactile feel." Tactile feel in this arrangement is defined as the collapse or abrupt diminution of counter force or pressure which creates or induces a sensory feeling of falling away from the original pressure felt by the operator. It is also noted in this regard that the torsion spring may itself be wound or coiled to provide varying spring forces. Conversely, the mounting pivot point may be located relative to the torsion spring ends effective to vary the required external actuation force.

As seen most clearly in the isometric view of FIG. 8 of the drawings, the actuation mechanism 10 of the present invention, comprises a support member 12 which may be substantially rectangular in external configuration having a top flat plate member 14 with overhanging edges 15 which serve as a built-in stop against the apperture or associated keyboard opening discussed in detail later on herein, and also provided with a vertically disposed free standing projection 16 and a solid bottom portion 18. The opposite left and right vertical side wall portions 20 and 22 of member 12 are smooth finished as shown with the rightward rear vertical edge portion 24 chamfered as seen in the drawings for purposes to be explained shortly.

Member 10 as illustrated in FIG. 8 is provided with an enlarged central cutout portion 26. Integral with and projecting outwardly from the rear solid wall 28 into the cutout portion 26, is a post, stud or pivot member 30. Member 30 acts as a rotative mounting support or pivot for a prewound and pretensioned torsion spring 32, as seen in FIGS. 2 and 3. In one structural configuration the coils of spring 32 are wound in a counterclockwise direction as shown in FIG. 2*a*. The initial coiling direction of spring 32 permits the spring to be used in a winding or an unwinding direction as seen in FIGS. 8 and 9 for purposes to be explained later on herein.

Pivot 30 is disposed intermediate the ends of support 12 and its location, as will be described, is used to alter the operation of the key and the tactile feel provided thereby. Spring member 32 is seated on member 30 so as to be freely rotative arcuately thereabout. The left and right opposite ends 34 and 36 respectively of torsion spring 32 are adapted to extend outwardly away from the center thereof and initially to be seated upon the internal oppositely disposed left and right edges 38 and 40 of support member 12 as seen most clearly in FIG. 3 of the drawings. As noted, the spring in its rest condition, i.e., before mounting on pivot 30, is provided with an end separation of approximately 90° so that the spring may in turn be deflected through an arc of less than 360°.

As seen in the lower portion of FIG. 8, and more clearly in FIGS. 1, 4 and 5, the support 12 is provided with a vertically extending cut 42 extending from the bottom portion 18 to the lower portion of the central cutout 26 and rightwardly into the body of the member 12 substantially to the midpoint thereof bifurcating the lower portion of member 12 into two identical halves 12*a* and 12*b* and enabling these two halves to be flexed very slightly toward one another for purposes to be explained shortly. Individual horizontal channels 44 slightly oblate in configuration as seen in FIG. 8 extend across the front face of member 12. Extending completely through the body of member 12 from front to back are individual oblate apertures or openings 46 forming channels extending through the member.

The lower edge of each member 12*a* and 12*b* is provided with a chamfered edge 48 angled downwardly from a ledge or lip 50 which extends from front to back of members 12*a* and 12*b* on the two opposite sides thereof. As seen in the various views of FIGS. 1, 4 and 5, the ledge or lip 50 provides retaining means for the member 12 when the member 12 is fully inserted by press fitting within the substantially rectangular channel opening 52, FIGS. 1, 4 and 5, in the supporting keyboard structure 54 with which the present device may be operably incorporated. In this instance the member 12 may be regarded as a key stem and as illustrated and described, the key stem is functionally operational with a photo optic keyboard in such manner that the series of substantially oblate cylindrical openings 44 and 46 extending therethrough, which while forming no part of the present invention, enables this apparatus to operate in a manner to expose or block light from a source not shown to receptors not shown located in the keyboard structure 54 per se.

FIG. 9 represents a modification of the structure illustrated and described in FIG. 8 and while the actuating mechanism is substantially identical to that of FIG. 8 the torsion spring is coiled in a reverse direction so that in use the spring would be "wound up" whereas the torsion spring of FIG. 8 would be "unwound" as it is utilized in a key stem mechanism. The support member or structure 56 of FIG. 9 comprises a rectangular member having a central vertical left-right structural wall or rib member 58 extending from side to side thereof and an orthogonally disposed front-back wall member or rib 60. The front portion of rib 60 is undercut as at 62 and is provided with an integral forwardly extending pivot mounting support member 64 for mounting a torsion spring 66 thereon. The oppositely extending left and right ends 68 and 70 respectively of spring 66 are adapted to be seated against the edges 72 and 74 of member 56. As with member 12 a plurality of horizontally extending oblate cylindrical channels 76 are formed in member 56. Front to rear oblate openings 78 are provided in the member 56, FIG. 9. A central vertical cutout or slot 80 similar to the cutout portion 42 of member 12 extends from the front surface into the middle portion of member 56 and enables the thus bifurcated lower portions 56*a* and 56*b* to be compressed slightly as member 56 is introduced into the receiving keyboard channel opening 52 of the keyboard in which it is to be operationally associated.

The bottom portion of member 56 is chamfered as at 82 and a ledge 84 is provided on opposite sides of the lower portion of member 56 acting as a retaining lip or stop for the "upward" movement of member 56 when it is disposed within the operationally associated keyboard. An upwardly projecting post 86 similar to member 16 in FIG. 8 is provided for member 56. This vertically projecting member 86 permits an alpha numeric indicating member such as a key top (not shown) to be attached to this stem portion. So as to relieve or avoid the possibility of error in applying the correct key top to the associated key stem a set of polarizing grooves are provided in member 16 as indicated at 88 and one or more outwardly projecting tangs or ridges 90 are provided in member 86 as in FIG. 9. This way the fabrication of the device permits the operator to assemble the alpha numeric keys to the key stem without the danger of misorienting the desired key. The rightward rear vertical edge is chamfered as at 92 for mating engagement with the angled corner 94 in each opening 52 in the keyboard 54. The lower edge portion 91 of the flat top or member 56 provides a "downward" stop for the key stem 56 when it is moved within member 54.

For purposes of the present description it is assumed that the actuation mechanism of the invention is incorporated into an operational keyboard such as that illustrated in partial sectional elevational view in FIGS. 1, 4 and 5 of the drawings. After the torsion spring has been preloaded onto the pivot with its ends extending over the edge portions as seen in FIG. 3 of the drawings, the key stem may then be inserted into the body of the keyboard by pressing the lower body portion into the opening provided in the keyboard such that the bifurcated end portions are slightly flexed toward one another until the rim or ledge at the bottom of each key snaps over the lower edge of the keyboard flexing the spring slightly to the position shown in FIG. 1. For practical purposes this position may be considered to be the preload position of the spring with respect to the keyboard. As the key is depressed by the finger of the operator the key movement will cause the spring to be wound around the pivot and to be tensioned as seen in FIG. 4 with the ends of the spring resting against the upper exposed edges of the keyboard openings within which the key is introduced. In the final position as illustrated in FIG. 5 the key has reached the lower terminus of its operational movement downwardly within the keyboard and the spring has flexed to its upward limit at which point the optics involved in this structure have performed the function of blocking and/or unblocking the light as it passes through the openings within the key structure.

Figure 7:
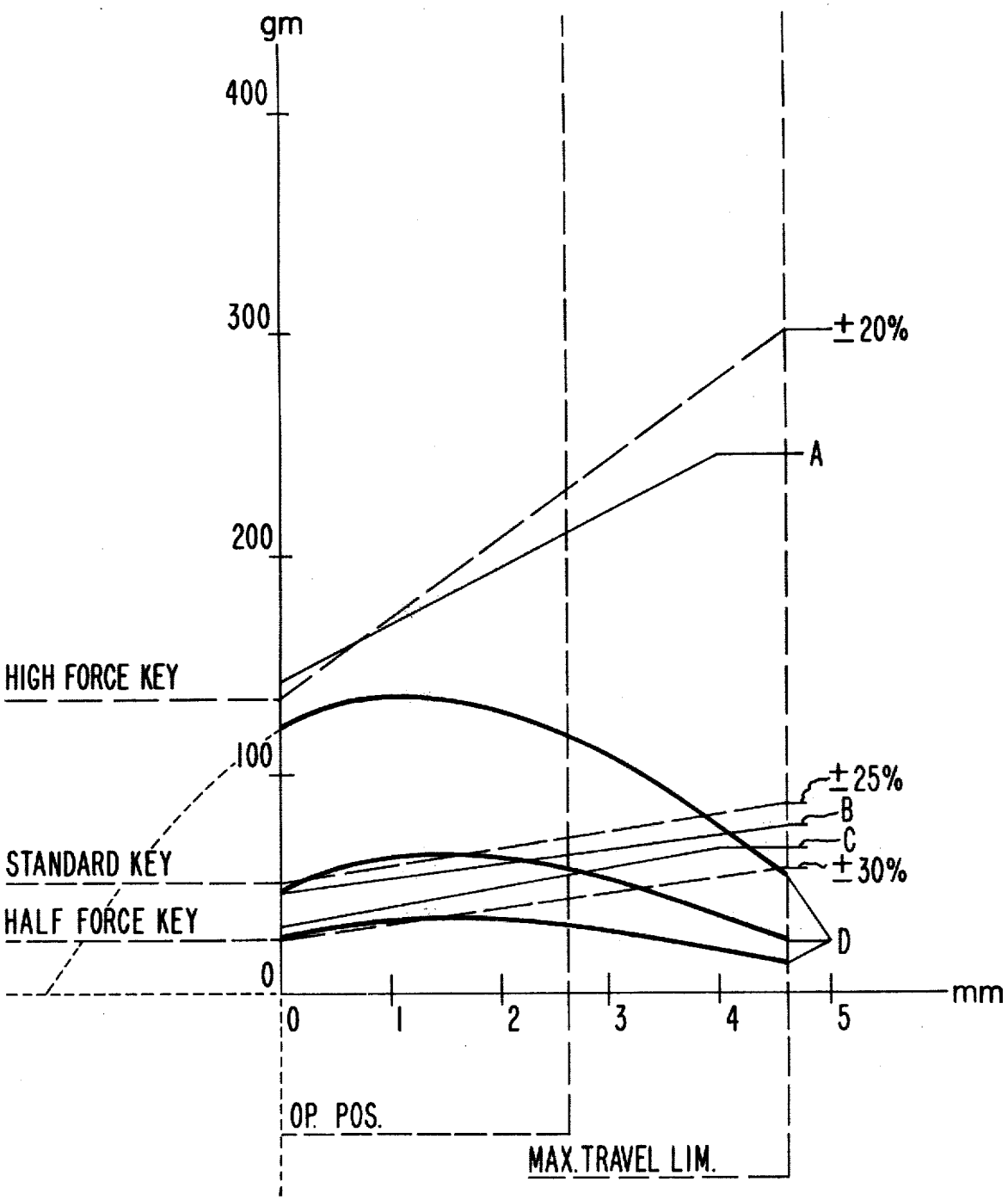
FIG. 7 is a graph comparing the various force load versus travel combinations of varying types of key actuating mechanisms with the actuation mechanism of the present invention depicted as the central curve of the graph.

As noted in connection with the graph of FIG. 7 the actuation mechanism of the present invention as shown by the line designated 92 illustrates the various stages through which the torsion spring is operational to produce a suitable sense of tactile feel by the operator. Position 1 can be stated to be at the zero point of the dotted line to the left of the vertical solid line in which the spring is free, FIG. 2, position 2 is approximately midpoint of the dotted line in which the spring is assembled to the pivot. The third position is approximately at the start of the solid portion of line 94 in which the spring is preloaded to the keyboard or housing. As seen, continued depression of the key permits the force to increase slightly to maximum at the top of the curve 94. Thereafter the actuation force, although increasing, starts to abruptly decrease until at a point slightly beyond top dead center the operator begins to feel the tactile sensation of a drop in the force which indicates to the operator that the switch has been actuated, closed or opened as the case may be. Finally at position 5 which is at the intersection of the solid line with the second righthand dotted vertical line the switch has closed completely and the operation is terminated.

As earlier noted herein, the basic concept involved in the present invention resides in the utilization of a torque spring, a pivot for mounting the torque spring and means for movably captivating the ends of the spring so that relative movement between the spring mounting means and the spring ends alters or changes both the degree and amount of applied force as well as the amount and degree of the resultant resistive force when the motion ensues.

Broad applications of this technique and structural combination are immediately available to the designer.

1. Any mechanical device where there is a requirement of a decreasing actuation force with respect to the travel of the actuating member producing this force.
2. Keyboard switches as previously disclosed and claimed.
3. Safety switches of varying types.
4. Push button switches.
5. Control switches for dangerous machinery and exotic pieces of equipment such as data processing apparatus.
6. Various types of safety equipment requiring electrical switch contacts.

As seen most clearly in the drawings, referring now to FIGS. 10*a* through 10*f* and 11*a* through 11*f* inclusive, the mechanism in its essential elements utilizes;

1. A support member or stem,
2. A torque spring having a coiled central portion and two oppositely disposed ends extending outwardly away therefrom (the spring may be wound clockwise "CW" or counterclockwise "CCW" depending solely upon usage requirements), and
3. Means to abut the spring ends for effecting relative movement between the spring ends and the stem or, put another way, whereby relative movement between the stem and the abutting means changes the required applied force and the resultant force resisting the change.

As a basic assembly the invention is schematically illustrated in FIGS. 10*a* through 10*f* as comprising a base 94 acting as a supporting structure for a reciprocably vertically movable stem or plunger-like member 96. Member 94 includes two parallel separated upstanding projections or tangs 98 having non-interfering upper end portions which for the sake of convenience are rounded as shown. Stem 96 is provided with a vertically depending projection or tang 100. The lowermost extremity thereof carries a horizontal forwardly extending stud 102 acting as a mounting pivot for a torsion spring 104. The coiled central portion of torsion spring 104 is seated on pivot stud 102 and is adapted to be freely rotatable thereabout to the predetermined limit of spring 104. Means for retention of member 96 relative to 94 has not been shown but can be accomplished by any of several well-known techniques.

Figure 6:
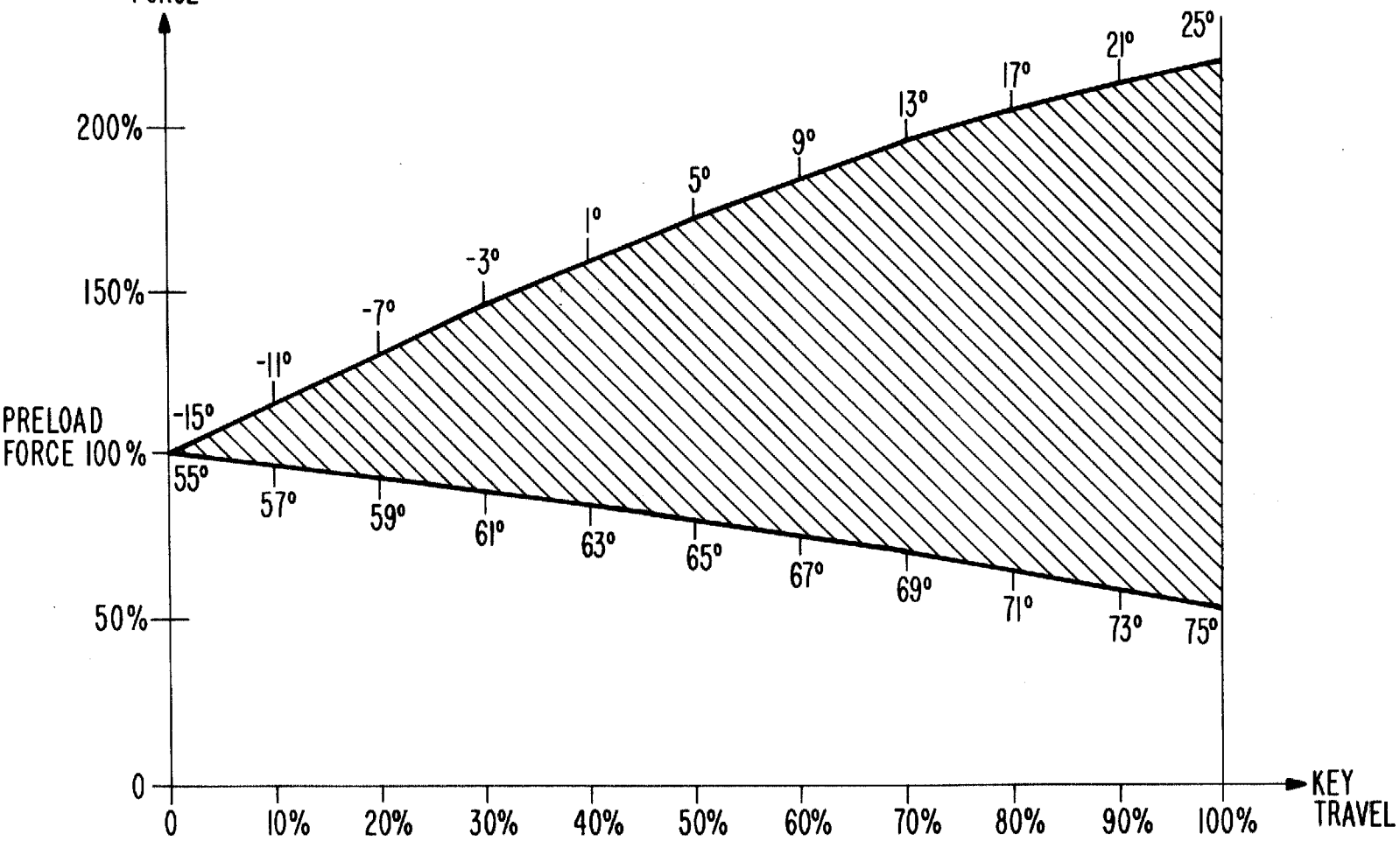
FIG. 6 is a force diagram of the key actuation force versus the key travel for the actuation mechanism of the present invention.
Figure 10:
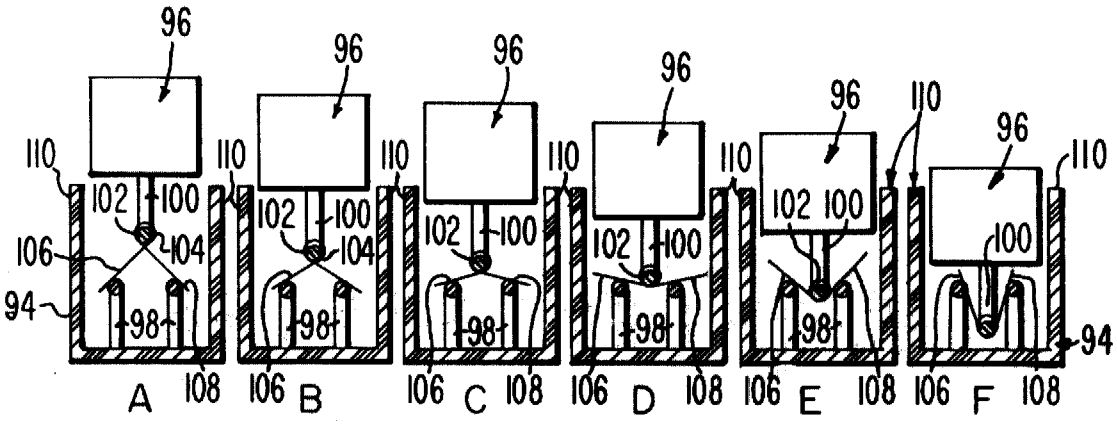
Figure 11:
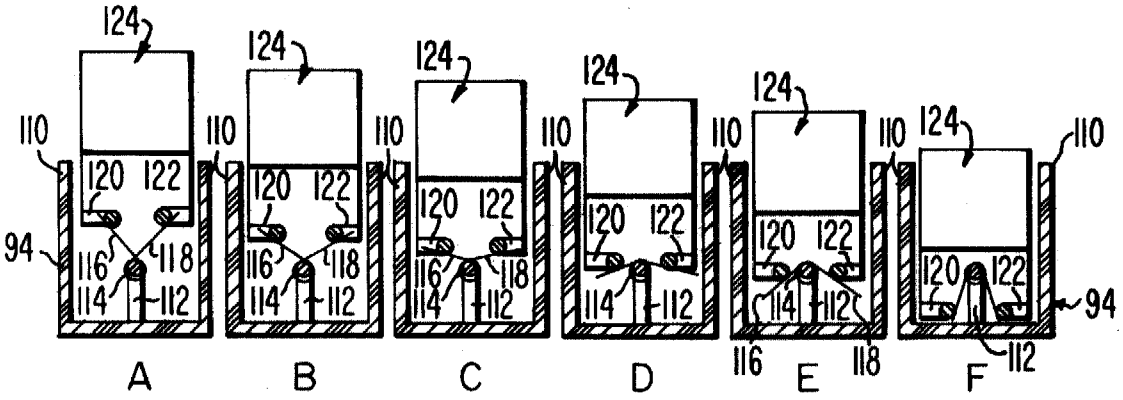

The right and left free ends 106 and 108 respectively of spring 104 abut the uppermost rounded portions of respective vertical tangs 98. Member 96 is adapted to be freely reciprocably movable vertically up and down in telescoping fashion between the upper side walls 110 of member 94 as will now be described with respect to FIG. 6. It is assumed for the sake of discussion that spring 102 in FIG. 10*a* is in its untensioned or unloaded condition. This position corresponds to the minus 15° position on the curve of FIG. 6. As the member 96 starts its downward motion with respect to member 94, the spring tension begins to increase as in FIG. 10*b* which corresponds to position approximately at the minus 7° position on the curve of FIG. 6. Still further motion of the member 96 in a downward direction brings the spring force to the position of FIG. 10*c* which corresponds to approximately 0° on the curve of FIG. 6. FIG. 10*d* corresponds approximately to the 5° position on the curve of FIG. 6. FIG. 10*e* corresponds to the position of approximately 21° on the curve of FIG. 6 and FIG. 10*f* which schematically illustrates the device in the so-called bottomed or lowermost position corresponds to the 25° position of the curve of FIG. 6. Each of these positions, of course, can be predetermined selectively and such positions and forces can be selectively altered by altering the position both of the pivot with respect to the member 96 as well as the abutting members 106 and 108 with respect to the pivot.

The views of FIGS. 11*a* through 11*f* are substantially similar to those of FIGS. 10*a* through 10*f*, the difference being that pivot stud 112 is now located on the fixed member 110 forming a mounting pivot for torsion spring 114. Left and right spring ends 116 and 118 respectively abut rightwardly and leftwardly projecting tangs 120 and 122 respectively, the latter integral with the movable member 124. As illustrated in FIGS. 11*a* through 11*f*, substantially the same forces apply with respect to the curve set forth in FIG. 6, but with the torsion spring 114 having its ends 116 and 118 distended in the opposite direction.

What is claimed is:

1. A photo-optical switching apparatus wherein a light blocking and unblocking element is movable from a light unobstructing position to a light obstructing position within a supporting assembly such as a keyboard, comprising:

an irregularly shaped slidably movable member centrally bifurcated so as to provide oppositely disposed parallel portions the latter being capable of slight compressive deformation toward and away from each other when said member is slidably disposed within a keyboard, a central flat portion terminating at its upper extremity in oppositely disposed abutments acting to retain said irregularly shaped member within an operably associated keyboard, the lower opposite edge portions of said irregularly shaped member terminating in parallel ledges acting to prevent accidental removal of said member after mounting within said keyboard, oppositely disposed pairs of parallel grooves extending from side to side of said irregularly shaped member, torsion spring mounting means projecting from said central flat portion, a torsion spring mounted on said mounting means, the opposite ends of said spring engaging the horizontal edges of said central flat portion effectively biasing said torsion spring to a desired tension, and optical passageways extending orthogonally through said grooves permitting light to pass through said passageways or be blocked from passage therethrough depending upon the relative position of said irregularly shaped member with respect to the keyboard with which it is operably associated.

2. The invention in accordance with claim 1, wherein said irregularly shaped movable member is provided with a rectangular upstanding projection including oppositely disposed vertical polarizing means adapted to engage a key top.

3. The invention in accordance with claim 1 wherein the parallel ledges of said centrally bifurcated member each includes an upwardly angled chamfer enabling said irregularly shaped member to be slidably captivated within the keyboard with which it is operably associated.

4. The invention in accordance with claim 1 wherein one or more oblate cylindrical openings are provided normal to said parallel grooves through which light is adapted to pass and from which light may be blocked upon relative movement of said irregularly shaped member relative to said keyboard.

5. The invention in accordance with claim 1, wherein said torsion spring is wound such that the spring coils tend to tighten relative to said mounting means as said mounting means is positionally displaced relative to the ends of said spring.

6. The invention in accordance with claim 1, wherein said torsion spring is initially coiled such that the coils tend to unwind relative to said mounting means as said mounting means is displaced relative to the ends of said spring.

7. The invention in accordance with claim 1, wherein said irregularly shaped member is angularly chamfered along one vertical edge providing polarizing-orienting means preventing misinsertion of said slidably movable member relative to said keyboard.

8. The invention in accordance with claim 1, wherein the position of said spring mounting means relative to said central flat portion of said irregularly shaped member is such that the sliding movement of said member relative to said keyboard produces an incidence angle of the torgue force relative to the actuation force effectively decreasing the actuation force with continued sliding movement of the irregularly shaped member.

* * * * *